US010112069B2

(12) United States Patent
Bertrand

(10) Patent No.: US 10,112,069 B2
(45) Date of Patent: Oct. 30, 2018

(54) CORE MUSCLE THERAPY APPARATUS

(71) Applicant: Scott Bertrand, College Park, GA (US)

(72) Inventor: Scott Bertrand, College Park, GA (US)

( * ) Notice: Subject to any disclaimer, the term of this patent is extended or adjusted under 35 U.S.C. 154(b) by 0 days.

(21) Appl. No.: 15/149,844

(22) Filed: May 9, 2016

(65) Prior Publication Data

US 2017/0319892 A1 Nov. 9, 2017

(51) Int. Cl.

| | |
|---|---|
| ***A63B 21/068*** | (2006.01) |
| ***A63B 23/02*** | (2006.01) |
| ***A63B 21/00*** | (2006.01) |

(52) U.S. Cl.

CPC ..... *A63B 21/068* (2013.01); *A63B 21/4049* (2015.10); *A63B 23/02* (2013.01)

(58) Field of Classification Search

CPC .... A63B 21/068; A63B 21/4049; A63B 23/02
See application file for complete search history.

(56) References Cited

U.S. PATENT DOCUMENTS

| | | | | |
|---|---|---|---|---|
| 1,342,871 A | | 6/1920 | Ruggles | |
| 1,344,255 A | * | 6/1920 | Beckman | A61G 15/007 297/327 |
| 1,393,456 A | | 10/1921 | Ruggles | |
| 2,487,730 A | | 11/1949 | Robb | |
| 3,089,692 A | | 5/1963 | Blomqvist | |
| 3,378,259 A | | 4/1968 | Kupchinski | |
| 3,567,218 A | | 3/1971 | Johnson | |
| 3,936,047 A | | 2/1976 | Brandt | |
| 4,113,250 A | * | 9/1978 | Davis | A61H 1/0218 472/16 |
| 4,194,500 A | | 3/1980 | Grimaldi | |
| 4,214,790 A | | 7/1980 | Sieber | |
| 4,356,577 A | | 11/1982 | Taylor | |
| 4,402,500 A | * | 9/1983 | Coles | A63B 19/04 434/55 |
| 4,438,761 A | | 3/1984 | McGowen | |
| 4,494,532 A | * | 1/1985 | Masuda | A63B 23/1227 482/144 |
| 4,511,137 A | | 4/1985 | Jones | |
| 4,546,967 A | | 10/1985 | Kecala | |
| 4,799,667 A | | 1/1989 | Suchy | |
| 5,275,132 A | | 1/1994 | Oloff | |
| 5,759,107 A | * | 6/1998 | Nagel | A63G 31/16 434/55 |
| 5,800,366 A | | 9/1998 | Bertrand | |

(Continued)

FOREIGN PATENT DOCUMENTS

EP 0211200 A1 2/1987

OTHER PUBLICATIONS

Website: http://www.engineerstudent.co.uk/pneumatics_vs_hydraulics.html Archived: Oct. 19, 2011 Retrieved: May 8, 2017.*

*Primary Examiner* — Loan H Thanh
*Assistant Examiner* — Megan Anderson
(74) *Attorney, Agent, or Firm* — Clayton, McKay & Bailey, PC

(57) ABSTRACT

A core muscle therapy apparatus is presented. The apparatus is designed to work the muscles comprising the core of a user by allowing the user's own body weight to resist the force of gravity in up to a 360 degree environment. The core muscle therapy apparatus has a base, a cage assembly, and a seat assembly.

10 Claims, 6 Drawing Sheets

(56) References Cited

U.S. PATENT DOCUMENTS 5,967,956 A * 10/1999 Teeter ..... A61H 1/003
482/144
7,559,766 B2 * 7/2009 Epley ..... A61B 5/4863
434/34

* cited by examiner

CORE MUSCLE THERAPY APPARATUS

FIELD OF THE INVENTION

This invention relates generally to core muscle therapy, and more particularly to devices and methods of using a person's own body weight as resistance and to incorporate gravity to stress the body.

BACKGROUND OF THE INVENTION

Traditionally, it has been necessary to use multiple pieces of equipment to effectively train or rehabilitate the muscles that comprise the core. Current training requires the person to devote more time and energy by using several pieces of equipment in an attempt to exercise all the muscles involved. What is needed is a device and method to train and rehabilitate all of the muscles of the core.

SUMMARY

Presented herein is a core muscle therapy apparatus. The apparatus is designed to work the muscles comprising the core of a user by allowing the user's own body weight to resist the force of gravity in up to a 360 degree environment. The core muscle therapy apparatus comprises a base, a cage assembly, and a seat assembly. The base, which is designed to support the cage assembly and the seat assembly, has a first base frame and a second base frame.

In an exemplified aspect, the cage assembly is positioned substantially between the first base frame and the second base frame. The cage assembly has an upper cage frame member, a lower cage frame member, a first side cage frame member, and a second side cage frame member. In another aspect, the seat assembly is rotationally connected to the upper cage frame member at a third connection point and the lower cage frame member at a fourth connection point. In this aspect, the seat assembly is configured to rotate about a second axis of rotation that is substantially perpendicular to the first axis of rotation. In this configuration, the seat assembly has a seat configured to seat a user therein.

Related methods are also provided. Other apparatuses, methods, systems, features, and advantages of the expandable core muscle therapy apparatus will be or become apparent to one with skill in the art upon examination of the following figures and detailed description. It is intended that all such additional apparatuses, methods, systems, features, and advantages be included within this description, be within the scope of the core muscle therapy apparatus' use, and be protected by the accompanying claims.

DESCRIPTION OF THE FIGURES

The accompanying drawings, which are incorporated in and constitute a part of this specification, illustrate certain aspects of the instant invention and together with the description, serve to explain, without limitation, the principles of the invention. Like reference characters used therein indicate like parts throughout the several drawings.

DESCRIPTION OF THE INVENTION

Figure 1:
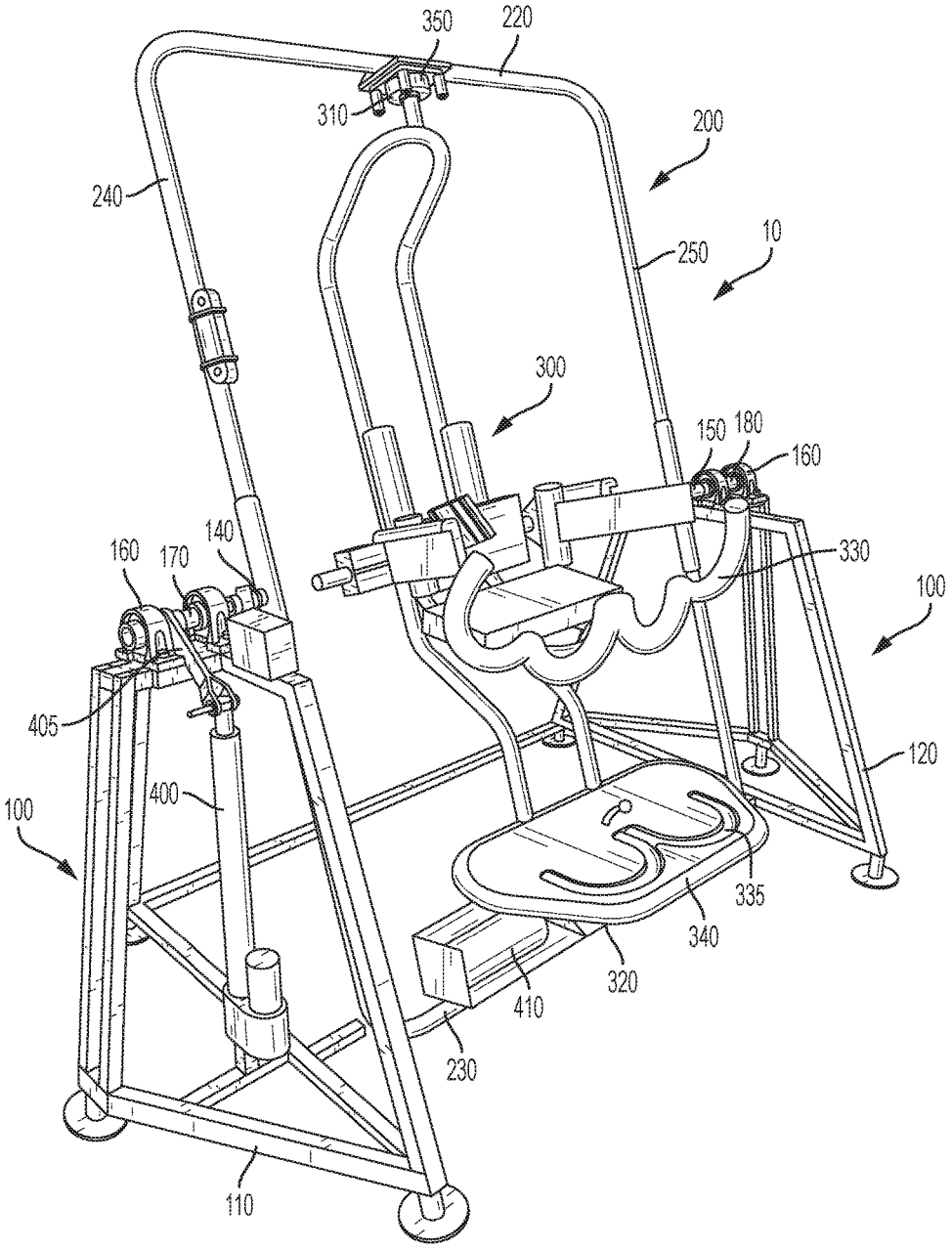
FIG. 1 is a perspective view of one aspect of a core muscle therapy apparatus.
Figure 2:
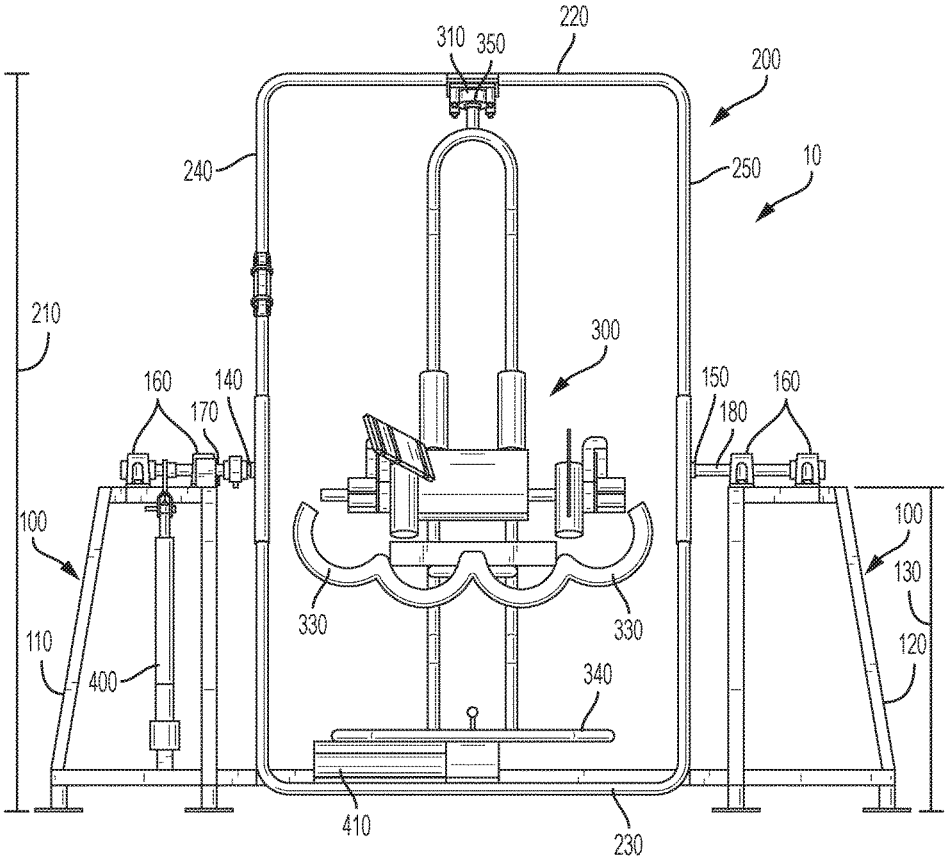
FIG. 2 is a front elevational view of the core muscle therapy apparatus of FIG. 1.
Figure 3:
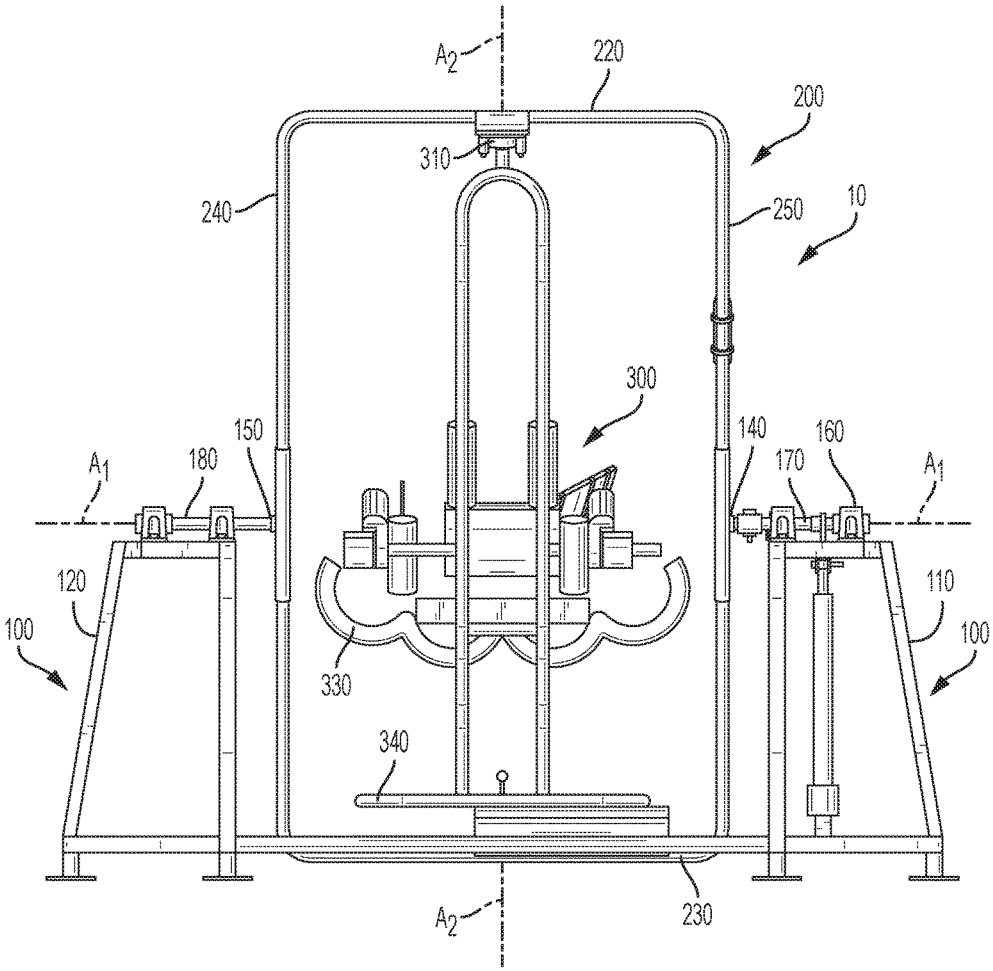
FIG. 3 a rear elevational view of the core muscle therapy apparatus of FIG. 1.
Figure 4:
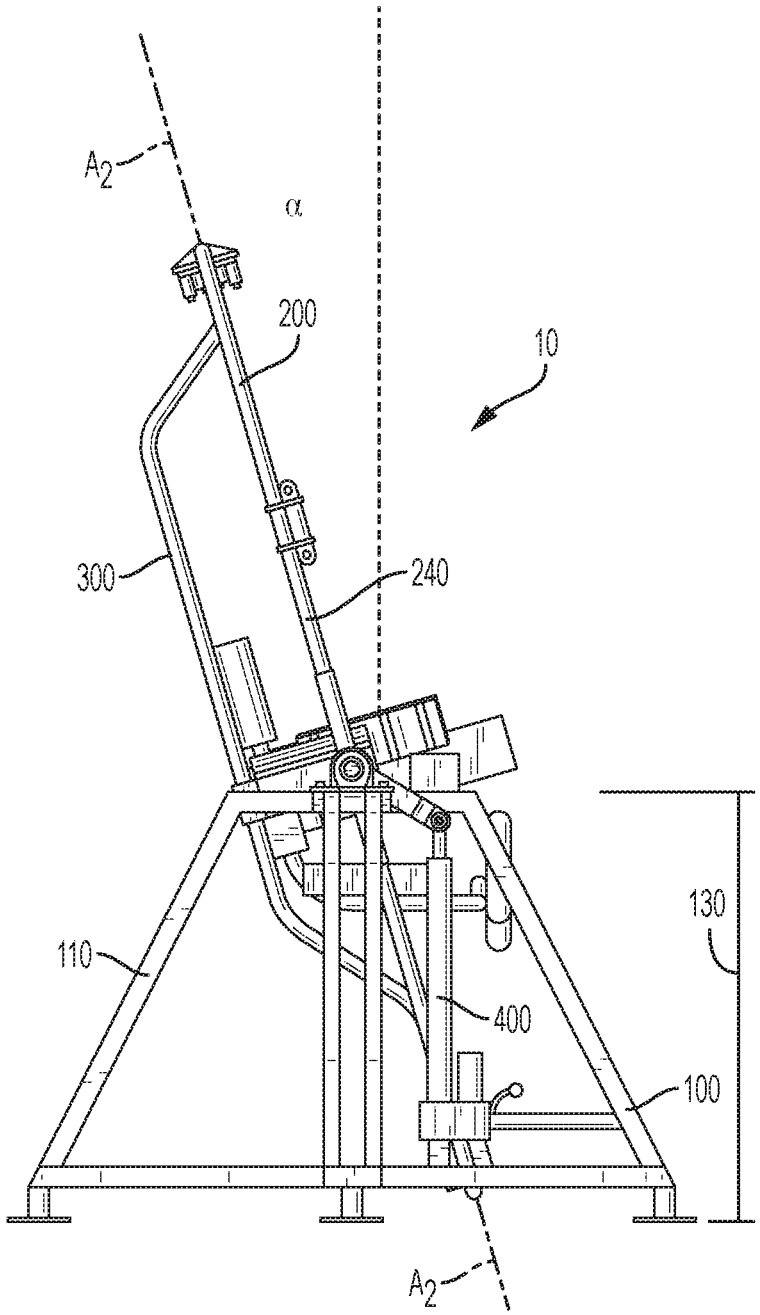
FIG. 4 is a left side elevational view of the core muscle therapy apparatus of FIG. 1.
Figure 5:
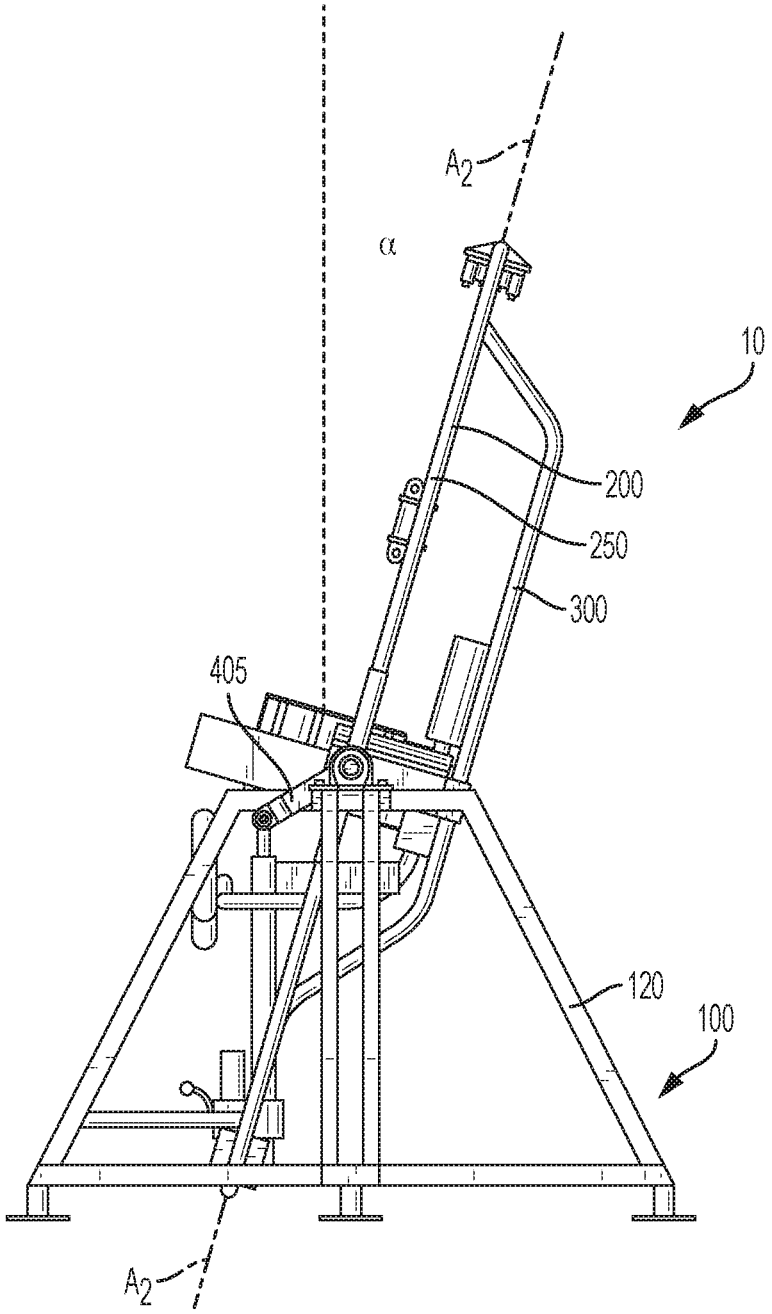
FIG. 5 is a right side elevational view of the core muscle therapy apparatus of FIG. 1.
Figure 6:
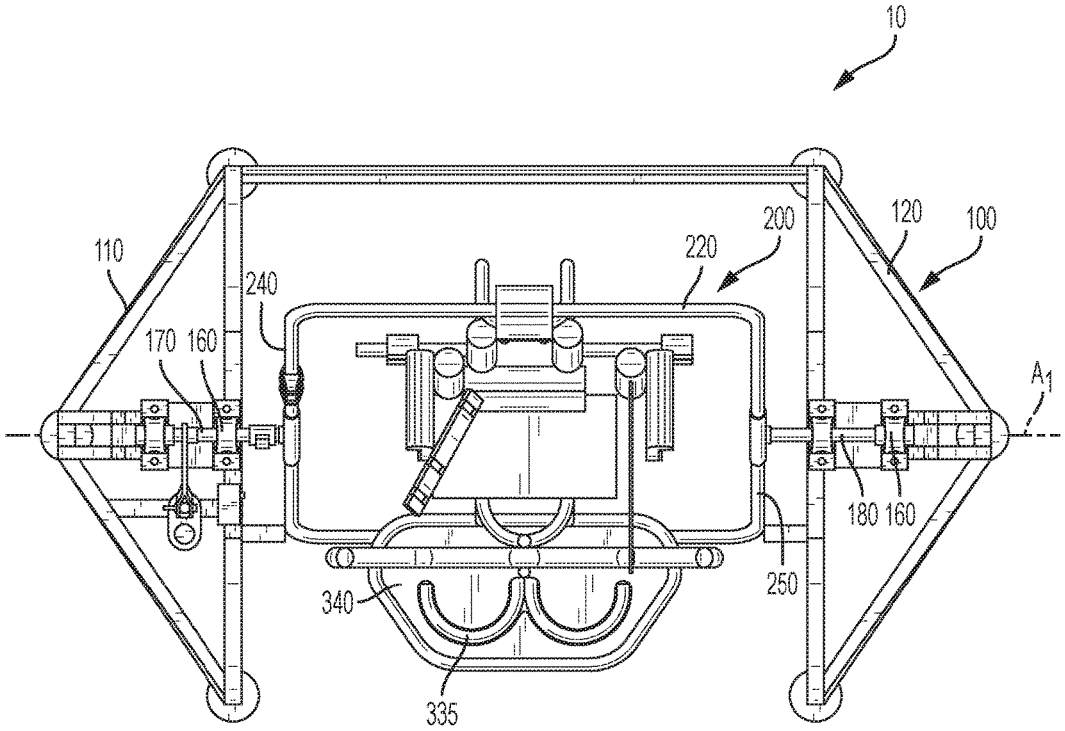
FIG. 6 is a top plan view of the core muscle therapy apparatus of FIG. 1.

The present invention can be understood more readily by reference to the following detailed description, examples, and claims, and their previous and following description. Before the present system, devices, and/or methods are disclosed and described, it is to be understood that this invention is not limited to the specific systems, devices, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. Those skilled in the relevant art will recognize that many changes can be made to the aspects described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to a "fastener" includes aspects having two or more fasteners unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Terms used herein, such as "exemplary" or "exemplified," are not meant to show preference, but rather to explain that the aspect discussed thereafter is merely one example of the aspect presented.

Additionally, as used herein, relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

In one aspect, presented herein is a core muscle therapy apparatus 10. The apparatus 10 is designed to work the muscles comprising the core of a user by allowing the user's own body weight to resist the force of gravity in up to a 360 degree environment. The core muscle therapy apparatus 10 comprises a base 100, a cage assembly 200, and a seat assembly 300. The base 100, which is designed to support the cage assembly 200 and the seat assembly 300, has a first base frame 110 and a second base frame 120. The first and second base frame can be separate units, or they can be integrally connected. The shape of the base frames is not important. In one aspect, the height 130 of each of the base frames is at least ½ of the length 210 of the cage assembly 200. The base frame, and other frame components of this apparatus, can comprise steel, aluminum, carbon fiber, or other sufficiently rigid material to support the weight of the user and components of the apparatus.

In an exemplified aspect, the cage assembly is positioned substantially between the first base frame 110 and the second base frame 120. The cage assembly has an upper cage frame member 220, a lower cage frame member 230, a first side cage frame member 240, and a second side cage frame member 250. The four frame members of the cage assembly 200 can define a four sided rectangle, but it is also contemplated that the cage assembly can define an ellipse, circle, or other shape whereby portions of the respective shape comprise the four frame members. The cage assembly 200 shown is a closed loop, but it does not necessarily have to be a closed loop. In one aspect, the first side cage frame member 240 is pivotally connected to the first base frame 110 at a first connection point 140 and the second side cage frame member 250 is pivotally connected to the second base frame 120 at a second connection point 150. In this aspect, the first axis of rotation $A_1$ is defined coaxial with a line formed between the first and second connection points. The cage assembly 200 is configured to rotate about the first axis of rotation $A_1$. It is contemplated that the cage assembly can rotate in either direction, or both.

In another aspect, the seat assembly 300 is rotationally connected to the upper cage frame member 220 at a third connection point 310 and the lower cage frame member 230 at a fourth connection point 320. In this aspect, the seat assembly is configured to rotate about a second axis of rotation $A_2$ that is substantially perpendicular to the first axis of rotation. It does not necessarily have to rotate 360 degrees, especially if it rotates in both directions. In this configuration, the seat assembly 300 has a seat configured to seat a user therein.

In an exemplified aspect, rotation of the cage assembly about the first axis of rotation moves the seat assembly 300 from a substantially upright position to a predetermined reclined position angle. "Substantially upright" does not necessarily mean at a 90 degree angle from the ground, but merely what is meant by "upright" conventionally when discussing a seated position. The predetermined reclined position angle $\alpha$ is generally from about 5 degrees to about 90 degrees, where the user is inverted. In this example, 0 degrees is the upright position. In another aspect, the predetermined reclined position is from about 5 degrees to about 60 degrees. In yet another aspect, the predetermined recline angle is from about 5 degrees to about 30 degrees. In this aspect, rotation of the seat assembly about the second axis of rotation rotates the user in the seat about the second axis of rotation at the predetermined reclined position angle $\alpha$.

In one aspect, the seat assembly 300 comprises a leg restraint 330. The leg restraint 330 can comprise strapping, similar to a seat belt, a bungee type cord, or a restraint similar to a roller coaster leg restraint. The leg restraint 330 is merely designed to assist in keeping the position of the user's legs stable when the seat assembly is rotated about the second axis, especially when it is reclined. In another aspect, the leg restraint can comprise a bar configured to substantially conform to the user's legs and move about and between a position where ingress and egress of the user's legs are permitted to a position where the legs are substantially immobilized. Additionally, the seat assembly 300 can comprise a seat belt fashioned to wrap around the user's waist and retain them therein the seat.

The seat assembly 300 can also comprise a foot platform 340 configured to permit the user to rest their feet during therapy. In one aspect, the foot platform 340 at least one foot restraint 335 for holding the user's feet in place. A single restraint configured for both feet could suffice, or there may be a pair of foot restraints, each configured to restrain one foot. In one aspect, the foot restraint 335 comprises a substantially semi-circular frame defining a hole to insert a foot. However, the shape is unimportant as long as the foot can be held therein. In another aspect, the foot restraint 335 is retractable to a position substantially coplanar with the foot platform. In this aspect, it makes it easier for the user to exit the apparatus after the foot restraint is retracted.

In once aspect, the first and second connection points 140, 150 each comprise at least one bearing housing 160 mounted to the first and second base frames, respectively. As can be seen in the figures, the first and second bearing housings 160 can each comprise two bearing housings to provide more stability, and wherein a at least one bearing resides within each bearing housing. In this aspect, the cage assembly 200 comprises a first shaft 170 attached to the first side cage frame member 240 and a second shaft 180 attached to the second side cage frame member 250, where the first and second shafts are substantially coaxial with the first axis of rotation $A_1$. It is also contemplated that the first and second shaft are integral with and defined by the first and second side frame cage members. In another aspect, the first shaft engages a bearing within the first bearing housing and the second shaft engages a bearing within the second bearing housing.

In an exemplified aspect, an electric cage assembly motor (not shown) can be operationally engaged with a portion of the cage assembly 200. In this aspect, the electric cage assembly motor is configured to rotate the cage assembly about the first axis. The shaft of the electric cage assembly motor can be connected to either the first or second shaft, either directly or via a gear box. In yet another aspect, a control system is present to drive the electric cage assembly motor and ensure that the cage assembly and, thus, the seat assembly is at the desired recline angle.

In yet another aspect, the cage assembly 200 can be rotated, at least partially, by a pneumatic piston 400 connected to a rocker arm 405 which, in turn, is connected to either the first or second shaft. Thus, movement of the piston 400 moves the rocker arm 405 and rotates the cage assembly about the first axis $A_1$.

In one aspect, the third and fourth connection points each comprise a bearing housing 350 mounted thereon the respective upper and lower cage frame members. The upper cage frame member comprises a third shaft and the lower cage frame member comprises a fourth shaft configured for operational engagement with the bearing housings of the third and fourth connection points, respectively. In another aspect, the third and fourth shafts are substantially coaxial with the second axis of rotation. In an exemplified aspect, an electric seat assembly motor 410 is operationally engaged with a portion of the seat assembly. In this aspect, the electric seat assembly motor 410 is configured to rotate the seat assembly about the second axis. The shaft of the electric seat assembly motor can be connected to either the third or fourth shaft, either directly or via a gear box. One design choice would be to mount the electric seat assembly motor 410 thereon one of the upper and lower cage frame members, such that the seat assembly can rotate about the second axis regardless of the reclined position angle. In another exemplified aspect, the electric seat assembly can be mounted under the foot platform 340, along with a gear box to translate the motion from a rotation parallel to the first axis to a rotation coaxial with the second axis.

Although several aspects of the invention have been disclosed in the foregoing specification, it is understood by those skilled in the art that many modifications and other aspects of the invention will come to mind to which the invention pertains, having the benefit of the teaching presented in the foregoing description and associated drawings. It is thus understood that the invention is not limited to the specific aspects disclosed hereinabove, and that many modifications and other aspects are intended to be included within the scope of the appended claims. Moreover, although specific terms are employed herein, as well as in the claims that follow, they are used only in a generic and descriptive sense, and not for the purposes of limiting the described invention.

What is claimed is:

1. A core muscle therapy apparatus, comprising:

a base comprising a first base frame and a second base frame;

a cage assembly positioned substantially between the first base frame and the second base frame, the cage assembly having an upper cage frame member, a lower cage frame member, a first side cage frame member, and a second side cage frame member, wherein the first side cage frame member is pivotally connected to the first base frame at a first connection point and the second side cage frame member is pivotally connected to the second base frame at a second connection point, wherein a first axis of rotation is defined coaxial with a line formed between the first and second connection points, and wherein the cage assembly is configured to rotate about the first axis of rotation;

a seat assembly rotationally connected to the upper cage frame member at a third connection point and the lower cage frame member at a fourth connection point, the seat assembly being configured to rotate about a second axis of rotation that is substantially perpendicular to the first axis of rotation, wherein the seat assembly comprises a seat configured to seat a user therein, and a pneumatic piston operationally engaged with a portion of the cage assembly via a rocker arm, the pneumatic piston positioned such that operation of the pneumatic piston causes the rocker arm to rotate the cage assembly at least partially about the first axis;

wherein rotation of the cage assembly about the first axis of rotation moves the seat assembly from a substantially upright position to a predetermined reclined position angle, and wherein rotation of the seat assembly about the second axis of rotation rotates the user in the seat about the second axis of rotation at the predetermined reclined position angle.

2. The core muscle therapy apparatus of claim 1, wherein the foot platform comprises a foot restraint.

3. The core muscle therapy apparatus of claim 2, wherein the foot restraint comprises a pair of foot restraints.

4. The core muscle therapy apparatus of claim 1, further comprising an electric seat assembly motor operationally engaged with a portion of the seat assembly, the electric seat assembly motor configured to rotate the seat assembly about the second axis.

5. The core muscle therapy apparatus of claim 4, wherein the electric seat assembly motor is mounted thereon one of the upper and lower cage frame members, whereby the seat assembly can rotate about the second axis regardless of the reclined position angle.

6. The core muscle therapy apparatus of claim 1, wherein the first and second connection points comprise a first and second bearing housing mounted to the first and second base frames, respectively, and wherein a bearing resides within each of the first and second bearing housings.

7. The core muscle therapy apparatus of claim 1, wherein the third and fourth connection points each comprise a bearing housing mounted thereon the respective upper and lower cage frame members, and wherein a bearing resides within each of the bearing housings.

8. The core muscle therapy apparatus of claim 1, wherein the rocker arm rotates the cage assembly by rotating a first shaft extending from the first side frame cage member.

9. A core muscle therapy apparatus, comprising:

a base comprising a first base frame and a second base frame;

a cage assembly positioned substantially between the first base frame and the second base frame, the cage assembly having an upper cage frame member, a lower cage frame member, a first side cage frame member, and a second side cage frame member, wherein the first side cage frame member is pivotally connected to the first base frame at a first connection point and the second side cage frame member is pivotally connected to the second base frame at a second connection point, wherein a first axis of rotation is defined coaxial with a line formed between the first and second connection points, and wherein the cage assembly is configured to rotate about the first axis of rotation; and a seat assembly rotationally connected to the upper cage frame member at a third connection point and the lower cage frame member at a fourth connection point, the seat assembly being configured to rotate about a second axis of rotation that is substantially perpendicular to the first axis of rotation, wherein the seat assembly comprises a seat configured to seat a user therein, wherein rotation of the cage assembly about the first axis of rotation moves the seat assembly from a substantially upright position to a predetermined reclined position angle, wherein rotation of the seat assembly about the second axis of rotation rotates the user in the seat about the second axis of rotation at the predetermined reclined position angle, and wherein the predetermined reclined position angle is limited to an angle from 5 to 90 degrees.

10. A core muscle therapy apparatus, comprising:

a base comprising a first base frame and a second base frame;

a cage assembly positioned substantially between the first base frame and the second base frame, the cage assembly having an upper cage frame member, a lower cage frame member, a first side cage frame member, and a second side cage frame member, wherein the first side cage frame member is pivotally connected to the first base frame at a first connection point and the second side cage frame member is pivotally connected to the second base frame at a second connection point, wherein a first axis of rotation is defined coaxial with a line formed between the first and second connection points, and wherein the cage assembly is configured to rotate about the first axis of rotation; and a seat assembly rotationally connected to the upper cage frame member at a third connection point and the lower cage frame member at a fourth connection point, the seat assembly being configured to rotate about a second axis of rotation that is substantially perpendicular to the first axis of rotation, wherein the seat assembly comprises a seat configured to seat a user therein, a first shaft operatively engaged with the first side cage frame member;

a second shaft operatively engaged with the second side cage frame member;

a first bearing housing comprising a bearing operatively engaged with the first shaft;

a second bearing housing comprising a bearing operatively engage with the second shaft;

wherein the first bearing housing is mounted to the first base frame at a first portion of the first base frame, wherein the first portion is oriented parallel to the first axis of rotation, wherein the second bearing housing is mounted to the second base frame at a second portion of the second base frame, wherein the second portion is oriented parallel to the first axis of rotation, wherein rotation of the cage assembly about the first axis of rotation moves the seat assembly from a substantially upright position to a predetermined reclined position angle, and wherein rotation of the seat assembly about the second axis of rotation rotates the user in the seat about the second axis of rotation at the predetermined reclined position angle.

* * * * *